United States Patent [19]

Wiczer

[11] Patent Number: 4,647,043

[45] Date of Patent: Mar. 3, 1987

[54] PINBALL MACHINE WITH FOLD-DOWN UPPER CABINET

[75] Inventor: Max Wiczer, Skokie, Ill.

[73] Assignee: Wico Corporation, Niles, Ill.

[21] Appl. No.: 694,981

[22] Filed: Jan. 25, 1985

[51] Int. Cl.[4] ..... A63F 7/34; E05D 15/50; E05D 11/10; A47B 88/00

[52] U.S. Cl. ..... 273/121 R; 16/231; 16/346; 16/349; 312/201; 312/251; 312/325; 312/327

[58] Field of Search ..... 273/119 A, 119 R, 121 A, 273/121 R, 122 A, 122 R, 285, 265; 16/231, 360, 349, 346, 323, 324; 312/325, 327, 251, 201

[56] References Cited

U.S. PATENT DOCUMENTS 3,675,927 7/1972 Gottlieb et al. ..... 273/119 A

FOREIGN PATENT DOCUMENTS 2161963 6/1972 Fed. Rep. of Germany ... 273/121 R

OTHER PUBLICATIONS

Zaccaria brochure for "Devil Riders" pinball game.

*Primary Examiner*—Richard C. Pinkham
*Assistant Examiner*—Benjamin Layno
*Attorney, Agent, or Firm*—Emrich & Dithmar

[57] ABSTRACT

A pinball machine has an upper display cabinet pivotally movable with respect to a lower playfield cabinet between an upright use position spaced well above the lower cabinet with the rear walls of the upper and lower cabinets substantially coplanar and a forwardly folded-down position closely overlying the lower cabinet. The upper cabinet is supported on a support assembly which includes upper and lower pairs of support posts, respectively mounted inside the upper and lower cabinets on the rear walls thereof, with each post having a forwardly projecting pivot portion, the upper and lower pivot portions being pivotally interconnected at their forward ends. The lower posts project well above the lower cabinet, and the pivot portions and the pivot pin are all disposed entirely within the upper cabinet. The upper cabinet is supported by the support assembly in both its upright and folded positions and, in its upright position permits a clear view of the entire playfield by a user.

18 Claims, 10 Drawing Figures

PINBALL MACHINE WITH FOLD-DOWN UPPER CABINET

BACKGROUND OF THE INVENTION

The present invention relates to pinball machines and, in particular, to pinball machines of the type which include a lower cabinet containing the playfield board and an upper cabinet containing various scoring displays and other displays. The invention has particular application to pinball machines which permit movement of the upper cabinet to facilitate storage and transport of the machine.

In many pinball machines a lower playfield cabinet has mounted thereon an upstanding display cabinet which projects vertically upwardly from the lower cabinet. This arrangement is inconvenient for storage and transportation of the pinball machine, because it occupies a considerable amount of space. Furthermore, the upper cabinet is exposed and vulnerable to damage or to being broken or dislodged from the lower cabinet when the machine is upended or otherwise tilted, as may be necessary during transportation.

To alleviate this problem, the upper cabinet may be made detachable from the lower cabinet. But detachable upper cabinets are inconvenient, since it requires considerable time and expense to disassemble and reassemble the two cabinets, including the several electrical interconnections therebetween.

In order to alleviate this problem, it is known to provide a pinball machine with a foldable upper cabinet which can be pivotally moved between an upright use position and a folded down position pivoted forwardly over the lower cabinet. But prior pinball machines with fold-down upper cabinets have simply used external piano-type highes on the bottom of the upper cabinet. This arrangement has provided to be disadvantageous. The upper cabinet has a considerable front-to-back thickness. Generally, the hinges are placed at the forward edge of the upper cabinet and at the rear end of the lower cabinet so that, when the upper cabinet is in its upright position it will overlie as little as possible of the lower cabinet, thereby permitting the maximum space available for the playfield board without any portion of the playfield board being obscured by the upper cabinet. But this necessitates that the upper cabinet will extend rearwardly well beyond the rear end of the lower cabinet, causing the entire pinball machine to take up additional floor space when in use. If the hinges are placed so that, when upright, the upper cabinet is arranged with its rear wall substantially in alignment with the rear wall of the lower cabinet, then the entire thickness of the upper cabinet will overlie the lower cabinet, occupying valuable cabinet space and necessitating that the playfield board be made smaller so that the rear end of it is not obscured by the upper cabinet.

A further disadvantage of the external piano-type hinges used in the prior pinball machines is that the hinges are visible when the upper cabinet is in its use position.

Another disadvantage of the prior arrangement is that piano-type hinges typically lack the strength to support the upper cabinet so that, in its folded position, it must rest upon and be supported by the lower cabinet.

BRIEF SUMMARY OF THE INVENTION

It is a general object of the invention to provide an improved pinball machine with a fold-down upper cabinet which avoids the disadvantages of prior such pinball machines while affording additional structural and operating advantages.

An important object of the invention is the provision of a pinball machine with a fold-down upper cabinet wherein the pivot machanism is concealed when the upper cabinet is in its use position.

Another object of the invention is the provision of a pinball machine of the type set forth, wherein the upper cabinet, when in its use position, does not increase the front-to-back floor space occupied by the machine, and yet at the same time permits an unobstructed view of a maximum size playfield area.

It is another object of the invention to provide a pinball machine of the type set forth, wherein the upper cabinet is supported by the pivot mechanism in both its upright and folded positions.

These and other objects of the invention are attained by providing in a pinball machine including a lower playfield cabinet and an upper display cabinet, the improvement comprising: first support means mounted within the lower cabinet and having an exposed portion extending a predetermined distance above the lower cabinet, second support means mounted within the upper cabinet, and pivot means interconnecting the second support means and the exposed portion of the first support means and accommodating pivotal movement of the second support means and the upper cabinet with respect to the first support means and the lower cabinet between an upright use position and a folded position, the upper cabinet in the upright use position thereof being spaced above the lower cabinet a distance sufficient to permit a clear view of the entire playfield by a user, the upper cabinet in the folded position thereof closely overlying the lower cabinet and the playfield.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figures 1, 2, 3, 4:
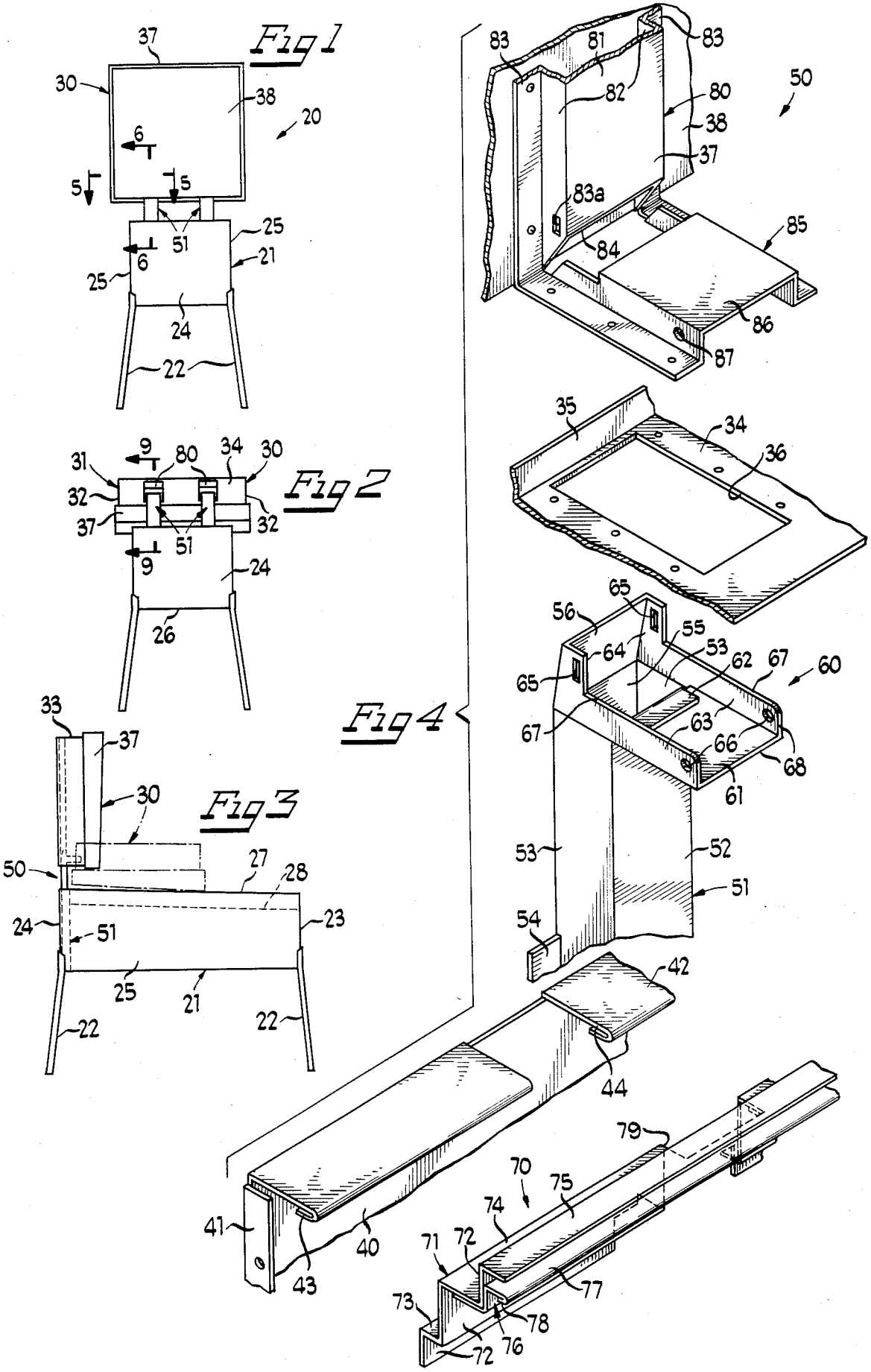
FIG. 1 is a rear elevational view of a pinball machine constructed in accordance with and embodying the features of the present invention, with the upper cabinet in its upright use position.
FIG. 2 is a view similar to FIG. 1, showing the upper cabinet in its folded down position.
FIG. 3 is a side elevational view of the pinball machine of FIG. 1, illustrating the folded down position in phantom.
FIG. 4 is an enlarged, fragmentary, exploded view of the upper cabinet support assembly of the present invention.

Referring to FIGS. 1-3 of the drawings, there is illustrated a pinball machine, generally designated by the numeral 20, including a lower cabinet 21 and an upper cabinet 30 supported above the lower cabinet 21 by a support assembly 50, constructed in accordance with and embodying the features of the present invention. The lower cabinet 21 is generally in the shape of a rectangular box and is supported upon the floor or other underlying support surface by four legs 22, respectively disposed at the corners of the lower cabinet 21. More particularly, the lower cabinet 21 includes upstanding, parallel, rectangular front and rear walls 23 and 24 and opposed side walls 25, the walls 23-25 all being interconnected and closed at their lower ends by a rectangular bottom wall 26. The walls 23-25 are all disposed substantially vertically, and each of the side walls 25 has a downwardly and forwardly sloping upper edge 27. Typically, a playfield board 28 is mounted in the lower cabinet 21 and is recessed a slight distance below the upper edges 27. The playfield board 28 may be covered with a transparent cover of glass, plastic or the like, all in a known manner.

Referring now also to FIGS. 4-9, the upper cabinet 30 includes a rectangular frame 31 including two opposed rectangular side walls 32, a top wall 33 and a bottom wall 34, each of the walls 32-34 being provided at the front edge thereof with an attachment flange 35 (FIG. 5) extending laterally outwardly therefrom substantially perpendicular thereto, so that the attachment flanges 35 are all substantially coplanar. The bottom wall 34 has a rectangular opening 36 therein (see FIGS. 4, 6 and 9) adjacent to the rear edge thereof for a purpose to be explained more fully below. Disposed forwardly of the front end of the frame 31 and secured to the flanges 35 is a rectangular shroud 37 for a display panel (not shown) which closes the front of the upper cabinet 30. The display panel typically carries decorative indicia and includes a variety of displays, including scoring displays, game status displays and the like, all in a known manner. Laterally inwardly extending attachment flanges 35*a* may also be formed on the rear ends of the walls 32-34 so as to overlap and be secured to the peripheral edges of an upstanding rectangular rear wall 38, which closes the rear end of the upper cabinet 30. Alternatively, the rear wall 38 may be unitary with the frame 31.

Disposed within the lower cabinet 21 and secured to the inner surface of the rear wall 24 thereof is a flat, rectangular mounting panel 40, provided along the opposite side edges thereof with integral forwardly-extending attachment flanges 41 (one shown in FIG. 4) for attachment, respectively, to the side walls 25 by suitable fasteners. The mounting panel 40 is provided at the upper edge thereof with an integral forwardly-extending retaining flange 42, which is preferably disposed a slight distance below the upper edge of the rear wall 24. The retaining flange 42 has the distal edge 43 thereof folded back upon itself, and has a pair of rectangular notches 44 formed therein (one shown in FIG. 4), for a purpose to be explained below.

Figures 5, 6, 7, 8, 9, 10:
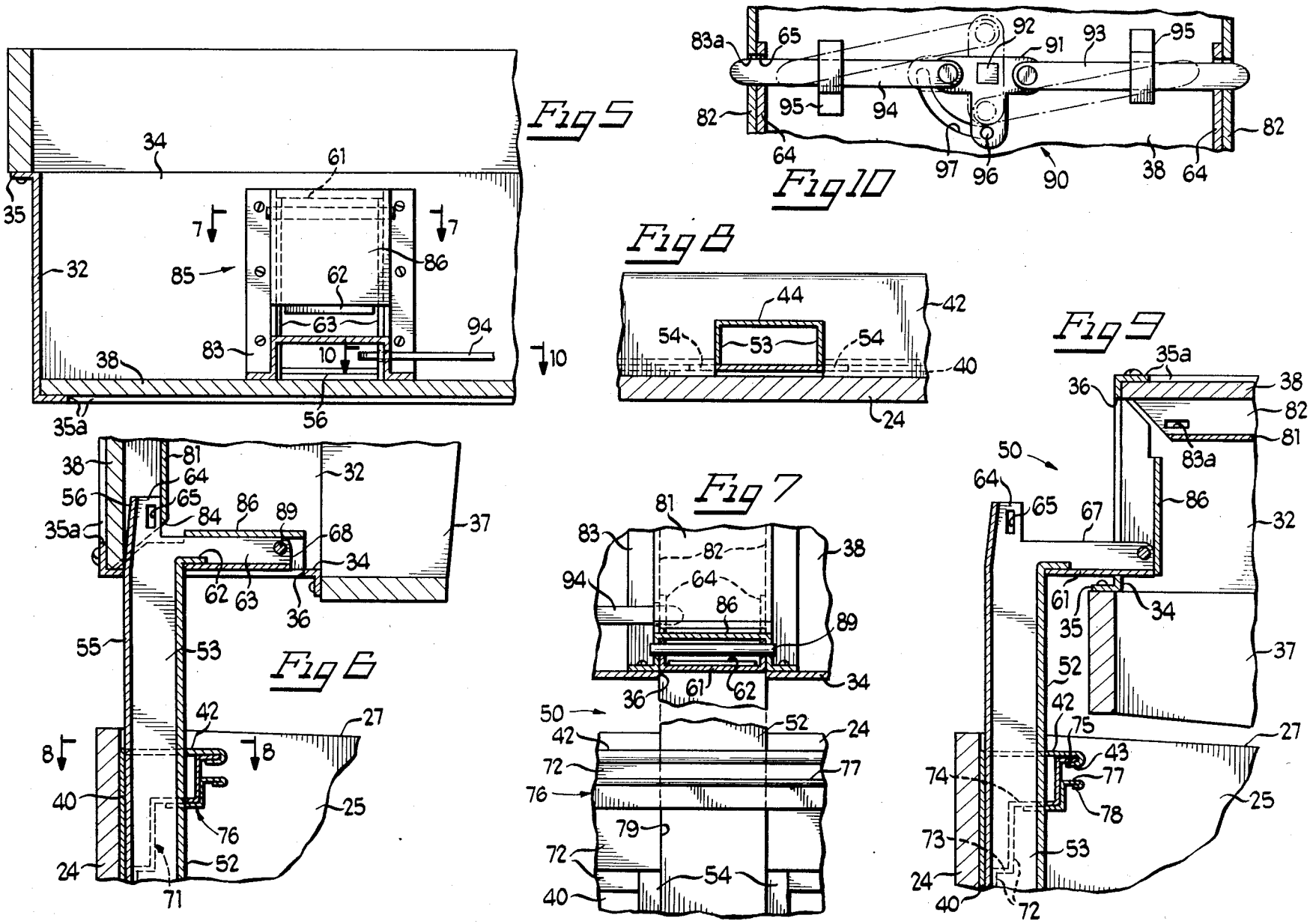
FIG. 5 is an enlarged, fragmentary view in horizontal section taken along the line 5—5 in FIG. 1.
FIG. 6 is an enlarged, fragmentary view in vertical section taken along the line 6—6 in FIG. 1.
FIG. 7 is a fragmentary view in vertical section taken along the line 7—7 in FIG. 5.
FIG. 8 is a fragmentary view in horizontal section taken along the line 8—8 in FIG. 6.
FIG. 9 is an enlarged, fragmentary view in vertical section taken along the line 9—9 in FIG. 2.
FIG. 10 is a fragmentary view in vertical section taken along the line 10—10 in FIG. 5, and illustrating the latch assembly of the present invention.

It is a fundamental feature of the present invention, that the upper cabinet 30 is supported so as to be movable between an upright use position, illustrated in solid line in FIGS. 1, 3 and 6, and a folded-down position, illustrated in solid line in FIGS. 2 and 9 and in broken line in FIG. 3. The support assembly 50 is designed to accommodate this movement and to support the upper cabinet 30 in both its upright and folded-down positions.

More particularly, the support assembly 50 includes a pair of lower support posts 51 mounted in the lower cabinet 21, and a pair of upper support posts 80 mounted within the upper cabinet 30. The posts 51 and the posts 80 are laterally spaced-apart, as indicated in FIGS. 1 and 2. The lower support posts 51 are substantially identical in construction, as are the upper support posts 80, wherefore only one of each of the support posts 51 and 80 will be described in detail.

Each lower support post 51 is a generally channel-shaped member, including a flat rectangular bight portion 52 integral at the opposite side edges thereof with a pair of rearwardly extending, parallel, rectangular side legs 53. The lower support posts 51 are respectively disposed in the notches 44 in the mounting mounting panel 40 within the lower cabinet 21, and extend substantially vertically from near the bottom of the lower cabinet 21 to a point spaced well above the top of the lower cabinet 21, passing through suitable openings in the top thereof. Each of the side legs 53 is provided with a laterally outwardly extending attachment flange 54, which is disposed against the mounting panel 40 and is fixedly secured thereto and extends from the lower edge thereof to the retaining flange 42. The exposed portion of each support post 51 which extends upwardly above the retaining flange 42 is provided with a rectangular reinforcing plate 55, which interconnects the side legs 53 to form a rectangular tubular configuration. Preferably, each reinforcing plate 55 is provided with a forwardly sloped upper end 56 which extends upwardly above the upper ends of the side legs 53.

Two substantially identically-constructed pivot brackets 60 are respectively fixedly secured to the upper ends of the lower support posts 51. More particularly, each pivot bracket 60 is generally channel-shaped, including a flat rectangular bight plate 61 which extends forwardly from the bight portion 52 at the upper end thereof, substantially perpendicular thereto. In this regard, the bight portion 52 may be provided at its upper end with a forwardly extending lip 62 which overlaps the rear edge of the bight plate 61 and is fixedly secured thereto by suitable means, such as welding (see FIGS. 4 and 6). Respectively integral with the opposite side edges of the bight plate 61 and extending upwardly therefrom substantially normal thereto are two side flanges 63, which are respectively disposed substantially coplanar with the side legs 53 of the associated support posts 51 and extend along the top edges thereof to the reinforcing plate 55 (see FIG. 4). Each of the side flanges 63 is provided at its rear end with an upstanding arm 64, secured to the adjacent side edge of the reinforcing plate 55 and provided with a rectangular slot 65 therethrough.

The flanges 63 are also respectively provided adjacent to their forward ends with aligned circular holes 66 therethrough. The upper edges of the flanges 63 respectively define bearing surfaces 67, and the forward edges of the flanges 63 and the bight plate 61 define bearing surfaces 68.

There is also provided in the lower cabinet 21 a playfield glass support assembly 70, which includes a generally staircase-shaped main plate 71, having three parallel vertical risers 72 and two spaced-apart horizontal step flanges 73 and 74, respectively integral with the middle riser 72 at the lower and upper ends thereof and connecting it to the adjacent risers 72. The top riser 72 is provided at its upper edge with a forwardly extending horizontal mounting flange 75. The playfield glass support assembly 70 also includes an auxiliary plate 76 which is generally Z-shaped in transverse cross section and is fixedly secured, as by welding, to the inner surfaces of the top riser 72 and the horizontal step flange 74. The auxiliary plate 76 includes a horizontally forwardly extending support flange 77 disposed a predetermined distance beneath and parallel to the mounting flange 75. The support flange 77 has its distal edge 78 folded back upon itself. Formed in the rear edges of the main plate 71 are two laterally spaced-apart rectangular notches 79, which cut through the bottom two risers 72 and the horizontal step flanges 73 and 74.

In use, the support assembly 70 is disposed against the mounting panel 40 beneath the retaining flange 42 thereof. More specifically, the folded distal edge 43 cooperates with the overlapped portion of the retaining flange 42 to define a slot in which the mounting flange 75 is received, the bottom riser 72 being disposed flush against the inner surface of the mounting panel 40 and secured thereto by suitable means. When the support assembly 70 is thus mounted, the notches 79 are respectively aligned with the notches 44 for accommodating the support posts 51. The portions of the notches 79 which pass through the bottom riser 72 are widened to accommodate the attachment flanges 54 of the lower support posts 51, as can best be seen in FIGS. 4 and 7. The support flange 77 cooperates with the folded distal edge 43 of the retaining flange 42 to define a slotted recess for receiving the rear edge of the playfield glass for retaining it in place and supporting it on the support flange 77.

Each of the upper support posts 80 is also channel-shaped, including a flat rectangular bight portion 81, integral along the opposite side edges thereof with two rearwardly extending rectangular side legs 82. Each of the side legs 82 is integral with a laterally outwardly extending attachment flange 83, adapted to be fixedly secured by suitable fasteners to the rear wall 38 of the upper cabinet 30. The bight portion 81 and the side legs 82 are cut away adjacent to the lower edge of the rear wall 38 forming an opening 84, as best illustrated in FIG. 4, to permit the lower end of each support post 80 to be folded to define a pivot portion 85, which projects forwardly from the rear wall 38 substantially perpendicular thereto. The part of the bight portion 81 on the pivot portion 85 defines a bearing plate 86. The portions of the side legs 82 on the pivot portion 85 are provided adjacent to the forward ends thereof with aligned holes 87 therethrough.

The pivot portion 85 is disposed over the opening 36 in the bottom wall 34 of the upper cabinet 30, the portions of the attachment flanges 83 on the pivot portion 85 being fixedly secured to the bottom wall 34 by suitable fasteners. If desired, gussets (not shown) may be secured to the side legs 82 at the junction between the pivot portion 85 and the remainder of the upper support posts 80.

The bearing plate 86 of the pivot portion 85 is slightly wider than the bight plate 61 of the pivot bracket 60, so that the pivot portion 85 can be fitted down over the pivot bracket 60 in straddling relationship therewith, with the holes 87 respectively aligned with the holes 66 for receiving a pivot pin 89 to permit pivotal movement of the upper support posts 80 and the upper cabinet 30 with respect to the lower support posts 51 and the lower cabinet 21, as can best seen in FIGS. 6 and 9. The pivot axis defined by the pivot pin 89 is positioned so that, when the upper cabinet 30 is disposed in its upright use position, illustrated in solid line in FIGS. 3 and 6, the rear walls 24 and 38 of the lower and upper cabinets 21 and 30 are substantially in vertical alignment, with the outer surfaces thereof substantially coplanar. Thus, when the upper cabinet 30 is in its upright use position, it does not add to the overall front-to-back space occupied by the pinball machine 20.

As can be seen in FIG. 6, when the upper cabinet 30 is in its upright use position, the pivot brackets 60 and the pivot portions 85 on the upper support posts 80, as well as the pivot pin 89, are all completely concealed within the upper cabinet 30, which is spaced well above the lower cabinet 21, so that all portions of the playfield board 28 are visible to the player. It will also be noted that the bearing plate 86 rests upon the bearing surfaces 67 of the pivot bracket 60 for providing firm support for the upper cabinet 30, and serving as a stop to prevent further pivotal movement thereof rearwardly beyond its upright position.

Also, when the upper cabinet 30 is disposed in its upright use position, the arms 64 of the pivot brackets 60 are disposed upwardly within the upper support posts 80, with the slots 83a disposed in lateral alignment with the slots 65, and with the forward edges of the arms 64 disposed in engagement with the inner surfaces of the bight portions 81. This latter engagement serves as a further stop to limit rearward pivotal movement of the upper cabinet 30 (see FIG. 6).

It will be appreciated that there are electrical connections between the lower and upper cabinets 21 and 30. To effect these connections, electrical conductors may extend upwardly through one or both of the channels defined by the lower support posts 51, and thence through the openings 36 in the bottom wall 34 of the upper cabinet 30 and through the openings 84 in the upper support posts 80, into the upper cabinet 30. It will be understood that sufficient slack will be provided in these electrical conductors to accommodate the pivotal folding movement of the upper cabinet 30.

Referring also to FIGS. 5, 7 and 10, there is also provided a latch assembly 90 for locking the upper cabinet 30 in its upright use position. More particularly, the latch assembly 90 includes a generally T-shaped plate 91 mounted on the rear wall 38 of the upper cabinet 30 between the upper support posts 80 for pivotal movement about a pivot pin 92. Two elongated latch arms 93 and 94 are respectively pivotally connected to the two arms of the T-shaped plate 91, the distal ends of the latch arms 93 and 94 being respectively loosely received through guides 95. Fixedly secured to the stem of the T-shaped plate 91 is a handle 96 which projects rearwardly through a complementary arcuate slot 97 in the rear wall 38 for access by a user, to rotate the T-shaped plate 91 between a latching position, illustrated in solid line in FIG. 10, and an unlatching position, illustrated in broken line in FIG. 10.

In the latching position, the latch arms 93 and 94, respectively, extend through the aligned slots 83*a* and 65 in the inner side legs 82 and 53 of the support posts 80 and 51, for preventing pivotal movement of the support posts 80 with respect to the support posts 51. In the unlatching position, the latch arms 93 and 94 are withdrawn from the slots 83*a* and 65 to accommodate free pivotal movement of the upper cabinet 30 to is folded-down position, illustrated in FIGS. 2 and 9.

When the upper cabinet 30 is disposed in its folded-down position, it extends forwardly over the lower cabinet 21, but is given substantial support by the support assembly 50. Thus, referring to FIG. 9, the bearing plates 86 engage the bearing surfaces 68 on the pivot brackets 60 and cooperate with the pivot pin 89 to support the upper cabinet 30 on the lower support posts 51. Furthermore, the engagement of the bearing plates 86 with the bearing surfaces 68 serve as stops to limit forward pivotal movement of the upper cabinet 30. It can be seen that, even when the upper cabinet 30 is disposed in its folded-down position, the entire upper support posts 80, including the pivot portions 85 thereof, as well as the pivot pin 89, remain entirely recessed within the upper cabinet 30.

In a constructional model of the present invention, the walls 23–26 of the lower cabinet 21, and the shroud 37 and the rear wall 38 of the upper cabinet 30 may be formed of wood, plastic or other suitable material, while the frame 31, the mounting panel 40 and the support assembly 50 are all preferably formed of a suitable metal, such as steel.

From the foregoing, it can be seen that there has been provided an improved pinball machine with a fold-down upper cabinet, wherein the support and pivot mechanism for the upper cabinet is substantially completely disposed within the upper and lower cabinet so as to provide a pivotal movement which affords maximum visibility of the playfield board and concealment of the pivot mechanism when the upper cabinet is in its upright use position, while minimizing the space occupied by the pinball machine, and at the same time provides support for the upper cabinet in both its upright and folded-down positions.

I claim:

1. In a pinball machine including a lower playfield cabinet and an upper display cabinet, the improvement comprising: first support means mounted within the lower cabinet and having an exposed portion extending a predetermined distance above the lower cabinet, second support means mounted within the upper cabinet, and pivot means interconnecting said second support means and said exposed portion of said first support means and accommodating pivotal movement of said second support means and the upper cabinet with respect to said first support means and the lower cabinet between an upright use position and a folded position about a pivot axis disposed within the upper cabinet, the upper cabinet in the upright use position thereof being spaced above the lower cabinet a distance sufficient to permit a clear view of the entire playfield by a user, the upper cabinet in the folded position thereof closely overlying the lower cabinet and the playfield.

2. The pinball machine of claim 1, wherein said second support means is disposed entirely within the upper cabinet.

3. The pinball machine of claim 1, wherein said first and second support means respectively include first and second elongated support posts, said first and second support posts being disposed substantially in axial alignment when the upper cabinet is disposed in its upright use position.

4. The pinball machine of claim 3, wherein said pivot means defines a pivot axis disposed substantially perpendicular to the axes of said posts and spaced a predetermined distance therefrom.

5. The pinball machine of claim 3, wherein said first and second support means respectively include pairs of said first and second support posts.

6. The pinball machine of claim 1, and further including latch means engageable with said first and second support means for locking said second support means and the upper cabinet in the upright use position thereof.

7. The pinball machine of claim 6, wherein each of said first and second support means has an opening therein, said openings being disposed in alignment when said second support means is disposed in its upright use position, said latch means including a latch bar movable between a latching position engageable through said aligned openings and an unlatching position withdrawn from said openings.

8. The pinball machine of claim 1, wherein said first and second support means cooperate with said pivot means to support the upper cabinet in both the upright use position and the folded position thereof.

9. In a pinball machine including a lower playfield cabinet having a first mounting wall comprising a rear wall thereof and an upper display cabinet having a second mounting wall comprising a rear wall thereof, the improvement comprising: first support means mounted on the first mounting wall and extending a predetermined distance above the lower cabinet, second support means mounted on the second mounting wall, and pivot means interconnecting said first and second support means and accommodating pivotal movement of said second support means and the upper cabinet with respect to said first support means and the lower cabinet between an upright use position and a folded position, the upper cabinet in the upright use position thereof being spaced above the lower cabinet a distance sufficient to permit a clear view of the entire playfield by a user with said first and second mounting walls substantially in alignment with each other, the upper cabinet in the folded condition thereof closely overlying the lower cabinet and the playfield with said first and second mounting walls disposed generally normal to each other.

10. The pinball machine of claim 9, wherein each of the first and second mounting walls is a substantially flat planar wall, the first and second mounting walls being disposed substantially coplanar with each other when the upper cabinet is disposed in its upright use position.

11. The pinball machine of claim 9, wherein the upper cabinet folds forwardly to the folded position thereof.

12. The pinball machine of claim 9, and further including support structure associated with said first support means for supporting associated playfield structure.

13. The pinball machine of claim 12, wherein said support structure is disposed within and securely fastened to the lower cabinet.

14. In a pinball machine including a lower playfield cabinet having a first mounting wall and an upper display cabinet having a second mounting wall, the improvement comprising: first support means mounted within the lower cabinet and having an exposed portion extending a predetermined distance upwardly above the lower cabinet, said first support means having a first pivot portion adjacent to the upper end of said exposed portion projecting forwardly therefrom, second support means mounted within the upper cabinet and having a second pivot portion adjacent to the lower end thereof projecting forwardly therefrom, and pivot means interconnecting said first and second pivot portions adjacent to the forward ends thereof for accommodating pivotal movement of the upper cabinet between an upstanding use position spaced above the lower cabinet a distance sufficient to permit a clear view of the entire playfield by a user and a folded position closely overlying the lower cabinet and the playfield about a pivot axis disposed within the upper cabinet, said first pivot portion having first and second bearing surfaces thereon, said second pivot portion having a bearing member, said bearing member being engageable with said first bearing surface when the upper cabinet is in the upright use position thereof for limiting pivotal movement thereof, said bearing member being engageable with said second bearing surface when the upper cabinet is in the folded position thereof for limiting pivotal movement thereof.

15. The pinball machine of claim 14, wherein said first and second pivot portions are respectively formed integrally with said first and second support means.

16. The pinball machine of claim 14, wherein said first pivot portion includes a first channel-shaped member having a first bight plate which has said second bearing surface on the distal end thereof and first side legs which have said first bearing surfaces on the upper edges thereof, said second pivot portion including a second channel-shaped member having a second bight plate which comprises said bearing member and second side legs, said pivot means including a pivot pin extending through and pivotally interconnecting said first and second side legs, said second channel-shaped member overlying and straddling said first channel-shaped member with said second bight plate resting on said first bearing surfaces when the upper cabinet is disposed in its upright use position, said second bight plate being disposed substantially perpendicular to said first bight plate and in engagement with said bearing surface when the upper cabinet is disposed in its folded position.

17. The pinball machine of claim 14, wherein said second support means and said second pivot portion and said pivot means are all disposed entirely within the upper cabinet.

18. The pinball machine of claim 17, and further including retaining structure engageable with said first support means for resisting the forces exerted thereon by pivotal movement of the upper cabinet, securely to hold said first support means against the first mounting wall.

* * * * *